United States Patent [19]

Neavel et al.

[11] 4,206,033

[45] Jun. 3, 1980

[54] $CO_2$ PRETREATMENT PREVENTS CALCIUM CARBONATE FORMATION

[75] Inventors: Richard C. Neavel, Baytown, Tex.; Roy J. Brunson, Buffalo Grove, Ill.; Joseph J. Chaback, Worthington, Ohio

[73] Assignee: Exxon Research & Engineering Co., Florham Park, N.J.

[21] Appl. No.: 933,296

[22] Filed: Aug. 14, 1978

[51] Int. Cl.[2] ..... C10G 1/00; C10G 1/06

[52] U.S. Cl. ..... 208/8 LE; 208/8 R; 208/10

[58] Field of Search ..... 208/8 LE, 8 R, 10

[56] References Cited

U.S. PATENT DOCUMENTS

| | | | |
|---|---|---|---|
| 2,191,156 | 2/1940 | Pier et al. | 196/53 |
| 2,221,410 | 11/1940 | Pier | 208/8 LE X |
| 3,355,376 | 11/1967 | Gorin et al. | 208/10 |
| 3,505,204 | 4/1970 | Hoffman | 208/10 |
| 3,926,775 | 12/1975 | Schroeder | 208/10 |
| 4,121,910 | 10/1978 | Stambaugh | 208/8 LE X |

OTHER PUBLICATIONS

Def. Pub. Ser. No. 700,485 Pub. 4/22/69, Hemminger et al.

*Primary Examiner*—Delbert E. Gantz
*Assistant Examiner*—William G. Wright
*Attorney, Agent, or Firm*—Wayne Hoover

[57] ABSTRACT

Scale formation during the liquefaction of lower ranking coals and similar carbonaceous materials is significantly reduced and/or prevented by pretreatment with carbon dioxide. The carbon dioxide pretreatment is believed to convert the scale-forming components to the corresponding carbonate prior to liquefaction. The pretreatment is accomplished at a total pressure within the range from about 14 to about 68 atmospheres and a carbon dioxide partial pressure within the range from about 14 to about 34 atmospheres. Temperature during pretreatment will generally be within the range from about 100° to about 200° C.

7 Claims, 1 Drawing Figure

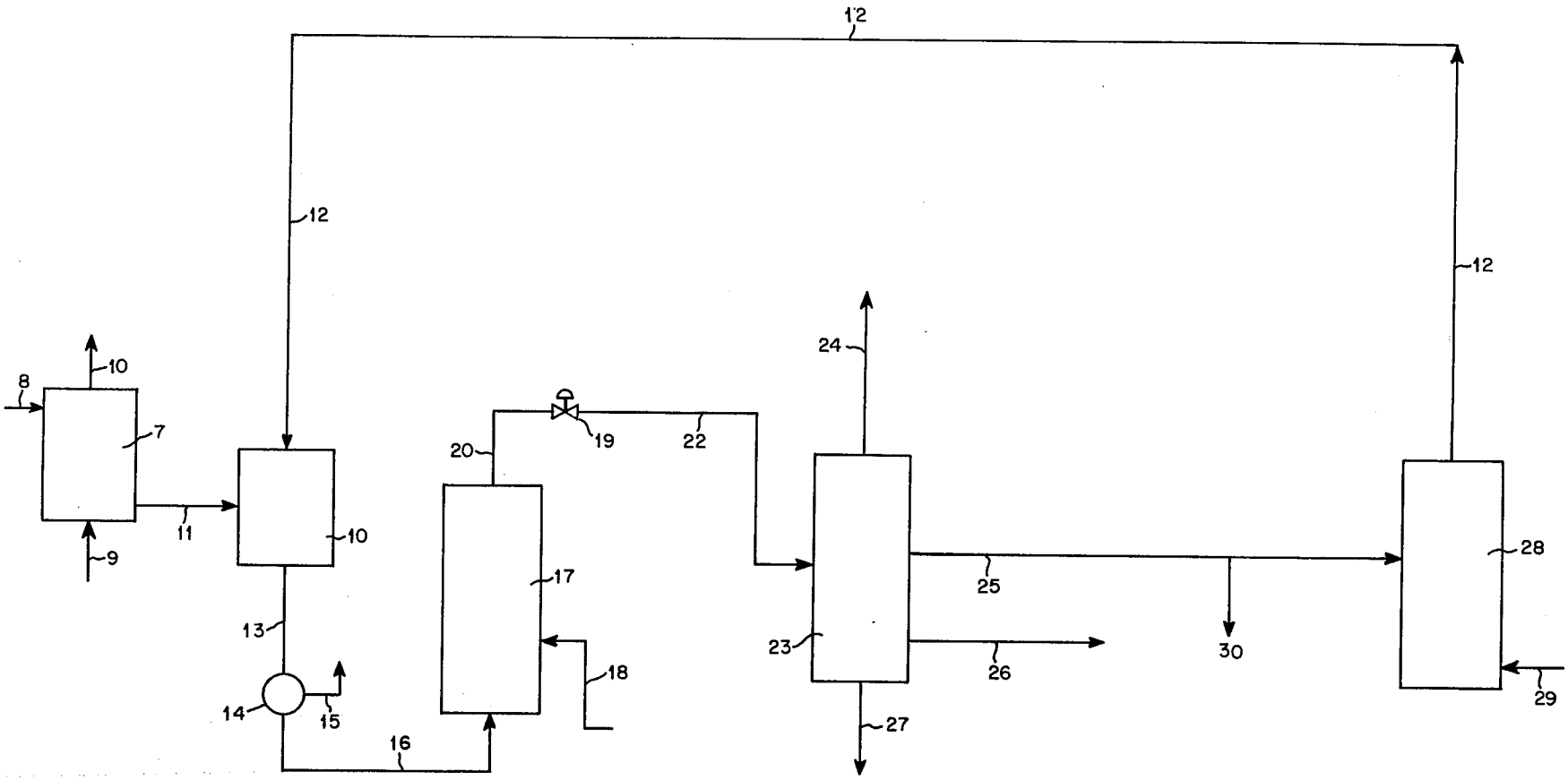
8
9
10
7
11
12
10
13
14
15
16
17
18
20
19
22
23
24
25
26
27
12
28
29
30
12

$CO_2$ PRETREATMENT PREVENTS CALCIUM CARBONATE FORMATION

The Government of the United States of America has rights in this invention pursuant to Contract No. E(49-18)-2353 awarded by the U.S. Energy Research and Development Administration.

BACKGROUND OF THE INVENTION

1. Field of the Invention

This invention relates to an improved process for converting coal or similar solid carbonaceous material containing certain mineral matter. More particularly, this invention relates to an improved process for liquefying coal and similar carbonaceous materials.

2. Description of the Prior Art

As is well known, coal has long been used as a fuel in many areas. For several reasons, such as handling problems, waste disposal problems, pollution problems and the like, coal has not been a particularly desirable fuel from the ultimate consumers point of view. As a result, oil and gas have enjoyed a dominant position, from the standpoint of fuel sources, throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously.

To this end, several processes wherein coal is either liquefied and/or gasified have been proposed heretofore. Of these, the processes wherein coal is liquefied appear to be more desirable in most cases since a broader range of products is produced and these products are more readily transported and stored. Difficulty has, however, been encountered during the liquefaction of certain coals, particularly the lower ranking coals, apparently as the result of extraneous mineral matter contained in these coals.

While the inventors here do not wish to be bound by any particular theory, it is believed that the operating difficulties are associated with the presence of one or more alkaline earth metals, particularly calcium, and to some extent the presence of iron, which react during liquefaction with available anions to form a solid scale or deposit. As liquefaction continues, the amount of scale increases in the liquefaction reactor thereby reducing reactor volume, and hence, the liquefaction contacting time and/or the total throughput. Ultimately, complete plugging may occur. Moreover, it is possible that portions of the scale or deposits can dislodge from the walls and result in downstream plugging.

The scaling and/or deposit problem is believed to have been first reported upon in the literature in connection with the operation of a high pressure coal liquefaction plant for producing liquids from lignites at Wesseling, near Cologne, Germany. According to the literature, operation of this plant was severely limited by a solid referred to as "caviar", the reference apparently stemming from the appearance of the solid in the form of agglomerated balls or spherulites. According to the literature, the spherulites were found to comprise calcium carbonate and hexagonal crystals of iron sulfide.

Early attempts to solve the problem involved the use of what might be termed engineering techniques which were designed either to prevent scale formation or to remove the scale before operating problems were encountered. In one such technique, a small slipstream was withdrawn from an initial reactor of a series in a process. With this technique, the initially formed particles were continuously withdrawn and removed and the slipstream then returned to the reactor. This technique aided in suppressing further crystal growth and slowed down the rate of scale formation within the reactor. The technique did, however, result in high gas losses and erosion rates within auxiliary equipment.

More recently, it has been discovered that calcium carbonate deposits which form during liquefaction as the result of the decomposition of various calcium organic compounds can be avoided by converting the calcium organic compounds which do decompose during liquefaction to a salt which will remain stable during liquefaction or to a form which can be removed prior to liquefaction. Conversions of this type can be effected with a relatively broad range of pretreating agents including salts of metals different from calcium which all, effectively, replace the calcium in the coal, various organic and inorganic acids and certain gaseous pretreating agents such as $SO_2$ and $SO_3$. Carbonic acid is included among the list of known pretreating agents.

For the most part, these ion exchange-type pretreatments have been quite effective in solving the scale or deposition problem. Most such treatments, however, involve the use of aqueous solutions of pretreating agents thereby increasing the amount of water which must be removed either prior to or during liquefaction. Moreover, many of these pretreatments increase the amount of ash or residue which must ultimately be discarded and/or involve the use of pretreating agents which are known as pollutants and therefore which must be separated from any gas stream ultimately vented to the atmosphere and some of which are hazardous in their own right. The need, therefore, for an improved method of avoiding the scale and/or solid deposition problem is believed to be readily apparent.

SUMMARY OF THE INVENTION

It has now, surprisingly, been discovered that the foregoing disadvantages of the prior art pretreatment methods can be overcome with the method of the present invention and a method for more effectively liquefying lower ranking coals provided thereby. It is, therefore, an object of this invention to provide an improved method for liquefying lower ranking coals and similar carbonaceous materials containing organic salts of alkaline earth metals which decompose during liquefaction to produce a scale and/or solid deposit which hampers smooth operation. It is still another object of this invention to provide such an improved process wherein the scale and/or solid deposition problem is avoided by pretreatment of the coal or similar carbonaceous material to be liquefied with a pretreating agent which does not require use of an aqueous solution. It is still another object of this invention to provide such an improved process wherein the pretreatment is accomplished with a pretreating agent which is not a pollutant and which is not itself hazardous to use. It is yet another object of this invention to provide an improved process wherein the pretreatment is accomplished with a pretreating agent which does not result in an increase in the amount of residue which must ultimately be discarded. These and other objects and advantages will become apparent from the description set forth hereinafter.

In accordance with this invention, the foregoing and other objects and advantages are accomplished by subjecting a lower ranking coal or similar carbonaceous material to a pretreatment with carbon dioxide and thereafter liquefying at least a portion of the same. As indicated more fully hereinafter, it is important that the pretreatment be accomplished with added carbon dioxide and that the pretreatment be accomplished at a total pressure of well above one atmosphere. As is also more fully indicated hereinafter, liquefaction of the pretreated coal or similar carbonaceous material may be accomplished in accordance with any of the techniques known in the prior art to be effective for this purpose.

BRIEF DESCRIPTION OF THE DRAWING

The attached drawing is a schematic flow diagram of a process within the scope of this invention.

DETAILED DESCRIPTION OF THE INVENTION

As indicated supra, the present invention relates to an improved process for the liquefaction of lower ranking coals and similar carbonaceous materials. The improvement comprises the pretreatment of the coal or similar carbonaceous material to either eliminate or at least significantly reduce the formation of solid deposits during liquefaction which ultimately results in scale formation and/or plugging. As also indicated supra, the scale and plugging is believed to be due to the decomposition of alkaline earth metal humates and particularly calcium humates during liquefaction and the concurrent or subsequent formation of calcium carbonate. In the present invention, the formation of the alkaline earth metal carbonate and particularly calcium carbonate during liquefaction is reduced or eliminated by forming the carbonate prior to liquefaction. As indicated more fully hereinafter, the alkaline earth metal carbonate which is formed during pretreatment will be finely divided and while it remains with the coal during liquefaction it does not agglomerate or form scale.

In general, the improved method of this invention can be used with any coal containing one or more alkaline earth metal humates and particularly any coal containing a calcium humate. Such coals include subbituminous coal, lignite, peat, brown coal and similar solid carbonaceous materials.

In general and prior to the pretreatment of this invention, the coal will be ground to a finely divided state. The particular particle size, or particle size range, actually employed will depend a great deal upon the optimum size to be used in the subsequent liquefaction conversion although the actual particle size range employed will have some effect on the rate of pretreatment and hence the rate of conversion of the alkaline earth metal humate to the corresponding alkaline earth metal carbonate. In this regard, it should be noted that in most liquefaction processes the coal to be liquefied will, generally, be ground to a particle size of less than about one-quarter inch and preferably to a particle size of less than about eight mesh NBS sieve size.

In general, the pretreatment of this invention will be accomplished by contacting an undried, finely divided, lower ranking coal with carbon dioxide. It is important that the contacting be accomplished at a total pressure well above one atmosphere. It is equally important that the partial pressure of carbon dioxide during the pretreatment be well above one atmosphere. There is, of course, no upper limit on either the total pressure during pretreatment or the $CO_2$ partial pressure. Nonetheless, the pretreatment will, generally, be accomplished at a total pressure within the range from about 14 to about 68 atmospheres and at a minimum $CO_2$ partial pressure during pretreatment within the range from about 14 to about 34 atmospheres.

In general, the temperature at which the pretreatment is accomplished is not critical and any temperature could be employed so long as the contacting time is adjusted so as to permit the conversion of at least a substantial portion of the alkaline earth metal humate. Elevated temperatures within the range from about 100° to about 200° C. will, however, be particularly effective at contacting times within the range from about 5 to about 60 minutes.

In general, the contacting between the coal and carbon dioxide can be effected in any manner known in the prior art to be effective for such contacting and the contacting may be accomplished either continuously or in a batch operation. When continuous contacting is employed, a moving bed or a fluidized bed of coal will generally be contacted with a gas stream containing sufficient carbon dioxide to provide from about 0.03 V/V/hour to about 3 V/V/hour of $CO_2$ per unit volume of coal. Also, when a fluidized bed technique is employed, sufficient gas will be used to maintain a fluidized bed of the particular coal. When batch treatment is employed, a fixed bed of finely divided coal may be contacted with a sufficient amount of gas to provide from about 0.1 to about 10 moles of $CO_2$ per kilogram of coal at a total pressure within the range from about 14 to about 68 atmospheres. Alternatively, a fixed bed of coal may be contacted with a gas stream containing sufficient carbon dioxide to provide a flow rate within the range from about 0.03 V/V/hour to about 3 V/V/hour of $CO_2$ per unit of coal.

Following the pretreatment, the coal may then be liquefied by any of the methods known in the art to be effective therefor. Such methods include processes wherein the coal is simply subjected to pyrolysis in the absence of air or oxygen, processes of the type where the coal is heated in the presence of hydrogen, and processes wherein coal is liquefied in the presence of a solvent.

In those processes where the coal is pyrolyzed either in the presence of an inert atmosphere or in the presence of hydrogen, contacting can be accomplished either in a fixed bed, a fluid bed or in a slurry. Generally, pyrolysis is effected at a temperature within the range from about 350° C. to about 800° C.

In those processes where a solvent is used, any liquid-solid contacting can be employed. In those processes wherein a carrier liquid or solvent is used, liquefaction is generally accomplished at a temperature within the range from about 350° C. to about 500° C. and the ratio of coal-to-liquid generally ranges from about 1:1 to about 1:4. The carrier liquid or solvent may or may not act as a hydrogen transferring media. In those cases where the carrier liquid and/or the solvent acts as a hydrogen donor, the carrier liquid and/or solvent will generally be withdrawn from the liquefaction vesel and hydrogenated so as to restore the desired hydrogen content. Such hydrogenation will, of course, be accomplished in accordance with techniques well known in the prior art; such as the process described in U.S. Pat.

No. 3,617,513, and forms no part of the present invention.

DESCRIPTION OF THE PREFERRED EMBODIMENT

In a preferred embodiment of the present invention, a lower ranking coal such as a subbituminous coal or a lignite is ground to a finely divided state and then contacted with carbon dioxide. The contacting will be accomplished at a space velocity, based on carbon dioxide, within the range from about 0.03 V/V/hour to about 3 V/V/hour. The contacting will also be accomplished at a total pressure within the range from about 14 to about 68 atmospheres and at a $CO_2$ partial pressure within the range from about 14 to about 34. Most preferably, the contacting will be accomplished at a temperature within the range from about 100° to about 200° C. The nominal contacting time will then range from about 5 to about 60 minutes.

In a preferred embodiment, the coal, during contacting, will contain at least 20 weight percent water and the contacting will be accomplished at conditions which avoid or prevent the loss of water during the pretreatment. In a most preferred embodiment, the coal will be treated "as received" and contain from about 25 to about 40 weight percent water.

When the coal is pretreated in accordance with the method of the preferred embodiment, from about 60 to about 90 percent of the alkaline earth metal humates originally present in the coal will be converted to an insoluble, thermally stable alkaline earth carbonate which remains within the coal and is released during liquefaction as particulate solids which are recovered with the liquefaction bottoms. Interestingly, even though the metal salt formed as a result of the pretreatment is believed to be the principle cause of scaling and/or plugging when the same is formed during liquefaction, the alkaline metal carbonate which is carried into the liquefaction stage after pretreatment remains finely divided, does not agglomerate, and does not result in scale formation and/or plugging.

Also in preferred embodiment, after the pretreatment, the pretreated coal will be admixed with a recycle donor solvent. The total solvent and coal will, generally, be admixed in a solvent-to-coal ratio ranging from about 0.8:1 to 4:1, most preferably from about 1.2:1 to about 1.6:1, based on weight. In the preferred embodiment, the solvent will be one derived from coal and, generally, will boil within the range from about 400° to about 850° F., most preferably from about 400° to 700° F. After the coal-solvent slurry is formed, the same will, generally, be combined with molecular hydrogen and fed to a coal liquefaction zone.

Within the coal liquefaction zone, liquefaction conditions include a temperature ranging from about 700° F. to about 950° F., preferably from about 800° F. to about 850° F. with pressures ranging from about 300 psia to about 3000 psia, most preferably from about 800 psia to about 2000 psia. Preferably, molecular hydrogen will be added to the liquefaction zone at a rate from about 1 to about 6 weight percent (MAF coal bases). Liquid residence times will, generally, range from about 5 to about 130 minutes and most preferably will range from about 10 to about 60 minutes.

The product from the coal liquefaction zone consists of gases and liquids, the liquids comprising a mixture of undepleted hydrogen donor solvent, depleted hydrogen donor solvent, dissolved coal, undissolved coal and mineral matter. In the preferred embodiment, the liquid mixture will be transferred to a separation zone wherein a light fraction useful as a fuel gas, a naphtha fraction, a hydrogen donor solvent fraction, a fuel oil fraction and a bottoms fraction is recovered. The bottoms fraction which, generally, will boil above about 1000° F., will include char, mineral matter and ash and may subsequently be fed to a gasification or coking process.

In the preferred embodiment, the solvent fraction will be hydrogenated before the same is recycled to the liquefaction zone. Preferably, the hydrogenation will be accomplished catalytically at conditions known in the prior art to be effective for this purpose. Normally, these include a temperature within the range from about 650° F. to about 850° F. and and a pressure within the range from about 650 psia to about 2000 psia. The hydrogen treat rate during the hydrogenation generally will be within the range from about 1000 to about 10,000 SCF/B. Any of the known hydrogenation catalyst may be employed. Following hydrogenation, the solvent may then be used to slurry additional pretreated coal.

As a result of the pretreatment, scaling and/or plugging which is normally encountered during the liquefaction of lower ranking coals is either significantly reduced or eliminated. As a result, longer periods of uninterrupted operation are possible and there is little, if any, need to reduce the throughput during these operations.

The present invention and a particularly preferred embodiment will become even more apparent from the following discussion which makes reference to the attached drawing. Referring then to the drawing, finely divided coal is fed to pretreatment vessel 7 through line 8. In the pretreatment vessel, the finely divided coal, which preferably contains between 25 and 40 weight percent water, is contacted with a gas containing $CO_2$ which enters through line 9 and is withdrawn through line 10. Total pressure is maintained between 14 and 68 atmospheres; the $CO_2$ partial pressure is maintained between 14 and 34 atmospheres; the temperature is maintained between 100° and 200° C. and the nominal contacting time is between 5 and 60 minutes. The treated coal is then introduced into mixing vessel 10 through line 11 and slurried with recycle solvent which is introduced through line 12. As indicated hereinafter, the recycle solvent is preferably hydrogenated prior to introduction into mixing vessel 10. The coal/solvent slurry is then withdrawn from the mixer through line 13 and passed through heat exchanger 14. In the heat exchanger, the slurry will be heated to a temperature within the range from about 300° to about 400° F. and in the embodiment illustrated steam will be withdrawn through line 15 so that the moisture content of the coal in the slurry will be within the range from about 1 to about 10 weight percent when the slurry is withdrawn through line 16 and fed to liquefaction vessel 17. In the liquefaction vessel, the coal/solvent slurry is combined with molecular hydrogen which is introduced through line 18. Generally, hydrogen will be added in an amount within the range from about 2 to about 8 weight percent based on dry coal. In the preferred embodiment, the liquefaction vessel will be sized so as to provide a nominal holding time within the range from about 20 to about 60 minutes and heat will be added or removed as required to maintain a temperature in the liquefaction vessel within the range from about 800° to about 880° F. Pressure in the liquefaction vessel will be maintained at a value within the range from about 1500 to about 2000 psia with control valve 19 which is located in product withdrawal line 20.

After the products from the liquefaction vessel pass through pressure control valve 19 they are then fed through line 22 to atmospheric fractionator 23. At this point, the product stream comprises product gases, product liquids, spent solvent, dissolved coal and mineral matter. In the atmospheric fractionator 23, the product stream is separated to a more desirable distribution. Essentially any distribution could, of course, be obtained, but in the embodiment illustrated, the gaseous components and the light liquid hydrocarbon products are taken overhead through line 24. A middle fraction comprising the spent solvent as well as liquid product boiling in the range of the spent solvent is withdrawn through line 25. A heavier liquid product is then withdrawn through line 26 and may be further separated using conventional techniques such as vacuum fractionation. The undissolved coal and the solid mineral matter is withdrawn through line 27. Again, the unreacted coal and the mineral matter may be subjected to further treatment such as coking and/or gasification using conventional techniques.

In the preferred embodiment, the solvent fraction withdrawn through line 25 will be hydrogenated before the same is recycled to mixing vessel 10. Preferably, the hydrogention will be accomplished catalytically at conditions known in the prior art to be effective for this purpose. In the embodiment illustrated, the hydrogenation is accomplished in hydrogenation vessel 28 with a gas comprising molecular hydrogen or a hydrogen donor introduced through line 29. The hydrogenated product is then recycled to mixing vessel 10 through line 12. In those cases where the amount of liquid withdrawn through line 25 exceeds the amount of solvent required during liquefaction, any excess may be withdrawn through line 30 prior to hydrogenation.

Normally, the hydrogenation will be accomplished at a temperature within the range from about 650° to about 850° F. and at a pressure within the range from about 650 to about 2000 psia. The hydrogen treat rate during the hydrogenation generally will be within the range from about 1000 to about 10,000 SCF/BBL. Any of the known hydrogenation catalysts may be employed but a nickel moly catalyst is most preferred.

Having thus broadly described the present invention and a preferred embodiment thereof, it is believed that the same will become even more apparent by reference to the following examples. It will be appreciated, however, that the examples are presented solely for purposes of illustration and should not be construed as limiting the invention.

EXAMPLE I 3 grams of a calcium acetate was combined with 10 grams water and placed in an autoclave. Pure carbon dioxide was then added to the autoclave to a pressure of 14 atmospheres. The contents of the autoclave were then brought to a temperature of 212° F. and held for a period of 60 minutes. The pressure on the autoclave was then released and the solid residue dried at 230° F. for about 3 hours. The solid residue was then analyzed and found to be carbonate. This example, then, clearly illustrates that calcium acetate can be converted to calcium carbonate by treatment with $CO_2$. Moreover, since calcium acetate is more difficult to convert to calcium carbonate than the calcium humates normally found in coal, it follows that this same treatment would convert the calcium humates. The water added in the above described procedure was, in effect, a substitute for water which would be present in a coal during treatment.

EXAMPLE II

In this example, the methods set forth in Example I were repeated except that the total autoclave pressure during pretreatment was reduced to 7 atmospheres and the holding time was again 60 minutes. Following this treatment, no solid residue was formed. Conversion to calcium carbonate did not occur.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention what is claimed is:

1. A process for the liquefaction of a lower ranking coal or similar solid carbonaceous material comprising the steps of:

(a) contacting said coal or carbonaceous materials with carbon dioxide at a partial pressure above one atmosphere so as to reduce the amount of alkaline earth metal humates therein;

(b) liquefying the thus treated coal at liquefaction conditions to produce a petroleum-like product; and (c) recovering the liquid product from the unliquefied portion of the pretreated coal or similar solid carbonaceous material.

2. The process in claim 1 wherein the coal or similar solid carbonaceous material is ground so that all particles are less than 1-quarter inch in diameter and then contacted with a gas stream containing sufficient carbon dioxide to provide from about 0.03 V/V/hour to about 3 V/V/hour of $CO_2$ per unit volume of coal.

3. The process in claim 1 wherein the coal or similar solid carbonaceous material is contacted with carbon dioxide at a total pressure within the range from about 14 to about 68 atmospheres and a carbon dioxide partial pressure within the range from about 14 to about 34 atmospheres.

4. The process of claim 3 wherein the nominal contacting time is within the range from about 5 to about 60 minutes and the temperature during contacting is within the range from about 100° to about 200° C.

5. The method of claim 1 wherein the liquefaction is accomplished in the presence of a hydrogen donor solvent.

6. The method of claim 5 wherein the liquefaction is accomplished in the presence of added molecular hydrogen.

7. The method of claim 6 wherein the liquefaction is accomplished at a temperature of about 800° to about 880° F. and at a pressure within the range from about 1500 to about 2000 psig.

* * * * *